US007578155B2

(12) United States Patent
Kleinfeldt et al.

(10) Patent No.: US 7,578,155 B2
(45) Date of Patent: Aug. 25, 2009

(54) WIRE-ROLLING STAND AND METHOD OF OPERATING SAME

(75) Inventors: Georg-Albert Kleinfeldt, Ratingen (DE); Lutz Kümmel, Jüchen (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 11/728,580

(22) Filed: Mar. 26, 2007

(65) Prior Publication Data

US 2007/0220941 A1 Sep. 27, 2007

(30) Foreign Application Priority Data

Mar. 25, 2006 (DE) ..... 10 2006 013 921

(51) Int. Cl.
*B21B 37/68* (2006.01)

(52) U.S. Cl. ..... 72/12.7; 72/11.8

(58) Field of Classification Search ..... 72/8.3, 72/8.4, 8.9, 9.2, 11.1, 11.6, 11.8, 12.7, 12.8, 72/205, 226, 234, 235
See application file for complete search history.

(56) References Cited

U.S. PATENT DOCUMENTS 4,665,730 A * 5/1987 Maroti ..... 72/205
5,305,624 A * 4/1994 Backhaus ..... 72/8.9
5,791,182 A * 8/1998 Ciani ..... 72/11.6
6,055,384 A * 4/2000 Kawakita ..... 396/538
6,055,834 A * 5/2000 Della Vedova et al. ..... 72/8.9
6,105,412 A 8/2000 Muller ..... 72/201
6,202,459 B1 * 3/2001 Palzer et al. ..... 72/8.9
6,568,234 B2 5/2003 Shore ..... 72/228

FOREIGN PATENT DOCUMENTS

DE 10048325 4/2002

* cited by examiner

*Primary Examiner*—Edward Tolan
(74) *Attorney, Agent, or Firm*—Andrew Wilford

(57) ABSTRACT

A rolling system has a rolling mill a rod workpiece, a wire block comprised of at least two roll stands downstream of the rolling mill, and a calibrating block comprised of three roll stands spaced apart in the direction downstream of the wire block. The workpiece is passed in the direction downstream in the direction from the rolling mill through the wire block and thereafter through the calibrating block with thickness reduction in each block. The gaps of the stands of the calibrating block are set at a fixed spacing and not varied during a rolling operation. A sensor measures the thickness of the workpiece upstream of the calibrating block, and gaps of the roll stands of the rolling mill or wire block are adjusted in accordance with the measured thickness such that the workpiece has a predetermined thickness on entering the calibrating block.

10 Claims, 1 Drawing Sheet

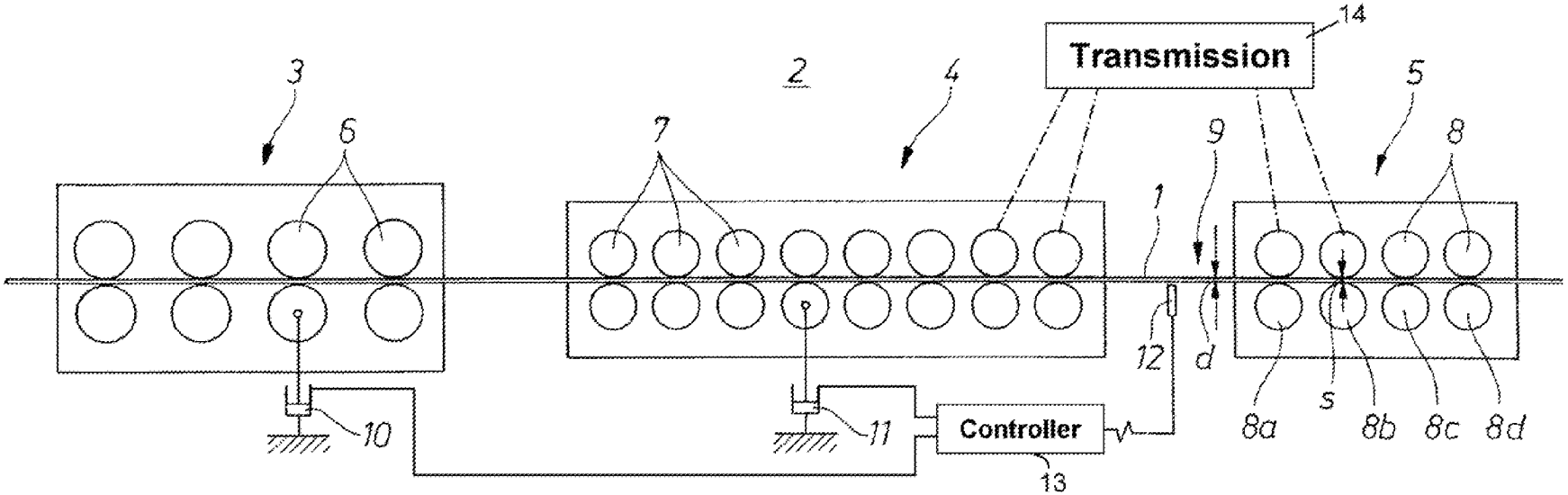
Transmission
Controller
14
5
8
8a
8b
8c
8d
s
9
d
1
12
13
4
2
11
7
3
6
10

WIRE-ROLLING STAND AND METHOD OF OPERATING SAME

FIELD OF THE INVENTION

The present invention relates to a wire-rolling system. More particularly this invention concerns a wire-rolling stand and method of operating it.

BACKGROUND OF THE INVENTION

In a standard rolling mill for making rod or wire (hereinafter referred to as wire) the wire/rod stock coming from the roll stands or prefinisher of the rod mill passes through a so-called wire block and thereafter through a calibrating block in which the final diameter and cross-sectional shape is imparted to the workpiece. Both the wire and calibrating blocks comprise a pair of roll stands spaced apart in the wire-travel direction. Thus the rolling of a workpiece to a finished wire is a three-stage process.

In the rolling mill or prefinisher, the wire rod block and the calibrating block, a plurality of roll stands are disposed, each of which has at least two interacting rolls, one above the other. The rolls are set at a defined spacing, resulting in the degree of workpiece deformation at the respective roll stand. The distance between two interacting rolls defines the roll gap or nip, which is crucial for the achieved degree of deformation.

It is known and common to adjust the rolls of the roll stands in the calibrating block specifically to such roll gaps that the wire has the desired final diameter after leaving the calibrating block. While the raw wire material is pre-rolled in the wire rod mill and in the wire rod block such that the diameter is rather close to the final dimension, precise calibration of the wire diameter only occurs in the calibrating block, to which end the rolls in the calibrating block are adjusted to the required roll gap.

The calibrating block therefore comprises control stages between the individual stands for adapting the reduction ratios to the defined fixed inlet diameter graduations from the wire rod block and/or from the rolling mill in the case of thick dimensions.

It is also known to provide two blocks with two roll stands each as the calibrating block, the stands being electrically adapted, if necessary, in order to be able to adjust the reduction ratios to fixed inlet diameter graduations as a function of the wire arriving from the wire rod block and/or—in the case of thick dimensions—from the rolling mill. Each block has a separate multimotor drive mechanism. The synchronization between the two blocks is performed electronically.

The disadvantage with this design is that it is very complex to properly configure the calibrating block since the rolls of the individual roll stands must be adapted to the individual roll gaps of the rolls in this block. This requires, for example, cost-intensive gear mechanisms on the calibrating block or electric synchronization.

OBJECTS OF THE INVENTION

It is therefore an object of the present invention to provide an improved wire-rolling stand.

Another object is the provision of such an improved wire-rolling stand and method of operating same that overcome the above-given disadvantages, in particular where the calibrating block is simpler and consequently less expensive, without negatively affecting the wire quality.

SUMMARY OF THE INVENTION

A method of operating a rolling system has according to the invention a rolling mill outputting in a travel direction a rod workpiece, a wire block comprised of at least two roll stands spaced apart in the direction downstream of the rolling mill, and a calibrating block comprised of at least two roll stands spaced apart in the direction downstream of the wire block, the method has according to the invention the steps of passing the workpiece downstream in the direction from the rolling mill through the wire block and thereafter through the calibrating block with thickness reduction in each block, providing at least three roll stands in the calibrating block, setting the three stands of the calibrating block at a fixed spacing and not varying this spacing during a rolling operation, measuring the thickness of the workpiece immediately upstream of the calibrating block, and adjusting gaps of the roll stands of the rolling mill or wire block in accordance with the measured thickness such that the workpiece has a predetermined thickness on entering the calibrating block.

The invention in terms of the method is thus characterized in that the wire is rolled in a calibrating block having at least three roll stands set at fixed roll gaps, and in that the roll gaps of the roll stands in the rolling mill and/or in the wire rod block are set such that the wire has a defined diameter directly upstream of the calibrating block.

The wire diameter upstream of the calibrating block is preferably influenced by setting the roll gap to a predefined dimension on several roll stands of the rolling mill and/or of the wire rod block as well as by disengaging the wire in at least one roll stand in the rolling mill and/or in the wire rod block. Disengaging means the rolls of the respective roll stand are moved apart so far that no rolling operation takes place in the stand, there is no workpiece deformation even if the workpiece still is touching one or more of the rolls of the stand. As a result of the disengagement, this roll stand is quasi bypassed in terms of the manufacturing process.

According to a further development, the disengagement occurs only in one or more of the stands of the wire rod block. It may even possible that the disengagement occurs in all roll stands of the wire rod block. According to this embodiment, the entire wire rod block would be bypassed and pre-rolling of the wire would be performed exclusively in the wire rod mill.

The wire-rolling system of this invention comprises a wire/rod rolling mill for rolling the wire that comprises at least one rolling stand, at least one wire rod block downstream of the rolling mill and at least one calibrating block downstream of the wire rod block for rolling the wire to the final dimension. The rolling mill, the wire rod block and the calibrating block each comprise at least two roll stands. According to the invention the roll gap of the three or more roll stands of the calibrating block relative to each other are fixed and means are provided for adjusting the roll gaps of the roll stands in the rolling mill and/or in the wire rod block.

According, it is provided, that the adjustment of the roll gap in the wire rod mill and optionally in the wire rod block is made specifically such that the raw wire material reaches the calibrating block with a predefined dimension—thickness and/or cross-sectional size and shape—and that in the calibrating block the wire is only finished and/or drawn to the desired finished size and shape in that it passes a plurality of these roll stands, which relative to each other are set at fixed roll gaps.

The means for setting the roll gaps of the roll stands in the rolling mill and/or in the wire rod block may be connected directly or indirectly to sensor means for measuring the wire diameter upstream of the calibrating block.

The calibrating block preferably comprises at least three roll stands, with four roll stands being particularly preferred. The wire rod block advantageously comprises eight roll stands. Finally, one embodiment of the invention proposes that the wire rod mill comprises only a single wire rod block and a single calibrating block.

The invention allows the calibrating block to have a much simpler design. It is possible to use a standard block, which preferably has a four-stand design. Cost-intensive gear mechanisms between the individual roll stands can be eliminated. This is made possible by optimized pre-rolling of the wire in the rolling mill and/or in the wire rod block.

Not only the gear mechanism on the calibrating block can be eliminated but such simplification also applies to the elimination of any integrated electronic synchronizing device. At the same time, controlled adjustment is possible, meaning all stands can be adjusted at the same time in accordance with the fixed reduction distribution.

In the calibrating block, a fixed reduction ratio from one roll stand to the next roll stand is defined, that is the gaps get smaller going downstream. The adjustment of the inlet cross-sections in accordance with the inlet dimension required for the end product is carried out by adding roll stands or eliminating, that is disengaging, individual stands in the wire rod block and the upstream rolling mill.

BRIEF DESCRIPTION OF THE DRAWING

The above and other objects, features, and advantages will become more readily apparent from the following description, reference being made to the accompanying drawing whose sole FIGURE shows in schematic form a rolling system for carrying out the method of this invention.

SPECIFIC DESCRIPTION

As seen in the drawing a wire rod mill 2 produces a wire or rod workpiece 1 in the conventional manner. This is carried out in three rolling assemblies arranged consecutively in a feed or travel direction D of the wire 1, namely first in the rolling mill 3, then in a wire rod block 4 and finally in a calibrating block 5. Each assembly 3, 4, 5 has a number of roll stands, respective assigned reference numerals 6, 7 and 8. The four roll stands 8*a*, 8*b*, 8*c* and 8*d* in the calibrating block 5 are shown in more detail.

The essential aspect is that the four stands 8*a*, 8*b*, 8*c*, and 8*d* in the calibrating block 5 have a fixed spacing or nip height s. This means that no adjustment or variation of the roll gaps is carried out during the rolling operation. Instead, according to the instant invention the wire 1 arrives at the calibrating block 5 already in such a pre-rolled state that a defined wire diameter d exists at a point 9 directly upstream of the calibrating block 5. As a result, the desired final dimension, e.g. thickness and cross-sectional shape, of the wire 1 can be attained in the calibrating block 5 without having to change the roll gap $s_5$ in this assembly 5.

So as to achieve this, sensor means 12 is provided upstream of the calibrating block 5 to detect the wire diameter d, so that the roll gap $s_3$ in the rolling mill 3 and/or the gap $s_4$ in the wire rod block 4 can be influenced by means of a controller 13 such that the desired wire diameter d exists upstream of the calibrating block 5. The controller 13 influences the actuators 10, 11 that are only shown schematically in order to set the roll gap $s_3$ in the rolling mill 3 and/or the gap $s_4$ in the wire rod block 4.

The preferred embodiment for rolling wire by means of a calibrating block has an 8-stand wire rod block 4 and a 4-stand calibrating block 5. Alternatively to the 4-stand calibrating block, it is also possible to use two 2-stand calibrating blocks disposed directly behind each other.

Two consecutive standard blocks, optionally with a mutual technologically required distance, are provided. The first wire rod block 4 is configured to have at least three stands 7. The second calibrating block 5 likewise comprises at least three stands 8, here four. It is preferable if the gear ratios of the individual blocks cannot be varied in relation to each other on both blocks 4 and 5. If required, they may be provided with a common manual transmission 14 between the motor and differential gearboxes of the stands 7 and 8 to maintain their rotation rates at fixed ratios.

In the second block 5 there are at least three stands 8. The required inlet cross-sections for this block may be produced as follows:

First, an operating mode without the first block 4 is possible. The setting of the cross-section by the rolling mill 3, also known as intermediate train or prefinisher, is known per se.

In the operating mode with the first block 4, the rolling operation is performed with pass rows or reduction distribution. The required cross-sections are produced by eliminating the last deforming step in the first block 4 and/or by opening and closing the passes in the first block 4.

We claim:

1. A method of operating a rolling system comprising:

a rolling mill outputting in a travel direction a rod workpiece;

a wire block comprised of at least two roll stands spaced apart in the direction downstream of the rolling mill; and a calibrating block comprised of at least two roll stands spaced apart in the direction downstream of the wire block, the method comprising the steps of:

passing the workpiece downstream in the direction from the rolling mill through the wire block and thereafter through the calibrating block with thickness reduction in each block;

providing at least three roll stands in the calibrating block;

setting the three stands of the calibrating block at a fixed spacing and not varying this spacing during a rolling operation;

measuring the thickness of the workpiece immediately upstream of the calibrating block during a rolling operation; and adjusting gaps of the roll stands of the rolling mill or wire block during a rolling operation in accordance with the thickness measured during the same rolling operation such that the workpiece has a predetermined thickness on entering the calibrating block.

2. The wire-rolling system defined in claim 1 wherein the gaps of the roll stands of the rolling mill or wire block are adjusted by spacing rolls of the respective roll stands out of engagement with the workpiece.

3. The wire-rolling system defined in claim 2 wherein only rolls of the wire block are disengaged from the workpiece.

4. The wire-rolling system defined in claim 3 wherein all rolls of the wire block are disengaged from the workpiece.

5. A wire-rolling system comprising:

a rolling mill outputting in a travel direction a rod workpiece;

a wire block comprised of at least two roll stands spaced apart in the direction downstream of the rolling mill; and a calibrating block comprised of at least three roll stands spaced apart in the direction downstream of the wire block, whereby the workpiece passes downstream in the direction from the rolling mill through the wire block and thereafter through the calibrating block with thickness reduction in each block;

respective actuator means connected to the roll stands for setting gaps thereof;

sensor means for measuring the thickness of the workpiece upstream of the calibrating block during a rolling operation; and control means connected to the actuator means and the sensor means for setting the three stands of the calibrating block at a fixed spacing and not varying this spacing during a rolling operation and for adjusting gaps of the roll stands of the rolling mill or wire block during the rolling operation in accordance with the thickness measured during the same rolling operation such that the workpiece has a predetermined thickness on entering the calibrating block.

6. The wire-rolling system defined in claim 5 wherein the sensor means is immediately upstream of the calibrating block.

7. The wire-rolling system defined in claim 5 wherein the calibrating block has five roll stands.

8. The wire-rolling system defined in claim 5 wherein the wire block has eight roll stands.

9. The wire-rolling system defined in claim 5 wherein there is only a single wire block and only a single calibrating block.

10. The wire-rolling system defined in claim 5 further comprising transmission means for maintaining a fixed speed ratio between the roll stands of the wire and calibrating blocks.

* * * * *